US007137853B2

(12) United States Patent
Okamoto et al.

(10) Patent No.: US 7,137,853 B2
(45) Date of Patent: Nov. 21, 2006

(54) CONNECTOR

(75) Inventors: Reiki Okamoto, Aichi-ken (JP); Harehide Sasaki, Aichi-ken (JP); Yoshiaki Kato, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 0 days.

(21) Appl. No.: 11/216,141

(22) Filed: Sep. 1, 2005

(65) Prior Publication Data

US 2006/0046581 A1 Mar. 2, 2006

(30) Foreign Application Priority Data

Sep. 2, 2004 (JP) ..... 2004-256078

(51) Int. Cl.
*H01R 13/574* (2006.01)
*H01R 13/627* (2006.01)

(52) U.S. Cl. ..... 439/752; 439/354

(58) Field of Classification Search ..... 439/752, 439/595, 354
See application file for complete search history.

(56) References Cited

U.S. PATENT DOCUMENTS 6,066,008 A * 5/2000 Brantingham et al. ..... 439/752
6,220,903 B1 * 4/2001 Huang ..... 439/894
6,435,919 B1 * 8/2002 Saka et al. ..... 439/752
6,780,070 B1 * 8/2004 Ishikawa et al. ..... 439/752
2002/0193014 A1 * 12/2002 Nakamura et al. ..... 439/752
2003/0119381 A1 * 6/2003 Maue et al. ..... 439/752

FOREIGN PATENT DOCUMENTS

JP 9-17484 1/1997

* cited by examiner

*Primary Examiner*—Hien Vu
(74) *Attorney, Agent, or Firm*—Roberts Mlotkowski & Hobbs; Thomas W. Cole

(57) ABSTRACT

A connector in which a housing and a retainer are coupled with sufficient strength when the connector is reduced in scale. In this connector, provisional anchoring pieces and main anchoring pieces are provided at two end portions of an inner peripheral wall of an insertion hole formed in the housing, with lengths along a direction that intersects a direction of insertion of the retainer into the insertion hole. At outer sides of two end portions of the retainer, anchorage pawls, which are formed to be engageable with the main anchoring pieces and the provisional anchoring pieces, are provided with lengths along the intersecting direction. With this structure, when the retainer is inserted into the insertion hole of the housing, the anchorage pawls engage, at two end portions of the connector, with the provisional anchoring pieces and with the main anchoring pieces.

4 Claims, 8 Drawing Sheets

CONNECTOR

CROSS-REFERENCE TO RELATED APPLICATION

This application claims priority under 35 USC 119 from Japanese Patent Application No. 2004-256078, the disclosure of which is incorporated by reference herein.

BACKGROUND OF THE INVENTION

1. Field of the Invention

The present invention relates to a connector suitable for, for example, connections of wire harnesses used in vehicles and the like.

2. Description of the Related Art

Connectors are employed for connections of, for example, wire harnesses used in vehicles and suchlike. More specifically, among such connectors, there are connectors which are provided with housings and retainers, one example of which has been disclosed in Japanese Patent Application Laid-Open (JP-A) No. 9-17484.

In this type of connector, a housing is formed in, for example, a substantially rectangular box shape, at one face of which (for example, a rear face) terminal insertion holes are plurally formed in an array, for insertion of terminals into that face.

An insertion hole is also formed in the housing, for insertion and fitting of a retainer thereinto. The insertion hole is formed to open at, for example, any face apart from the aforementioned one face and an opposing face which is opposite from the one face (for example, at a bottom face). Provisional anchoring pieces and main anchoring pieces, for engaging with the retainer, are respectively provided protruding from an inner peripheral wall of the insertion hole. Of the inner peripheral wall of the insertion hole, the peripheral anchoring pieces and the main anchoring pieces are provided at, for example, two end portions in a terminal arrangement direction, at inner peripheral walls of each of two end portions in a terminal insertion direction.

The retainer is formed to correspond with the insertion hole of the housing. The retainer is provided with provisional anchorage pawls, which correspond with the provisional anchoring pieces formed at the inner peripheral wall of the insertion hole of the housing. The retainer is also provided with main anchorage pawls, which correspond with the main anchoring pieces formed at the inner peripheral wall of the insertion hole of the housing. The provisional anchorage pawls and the main anchorage pawls are respectively protrudingly provided at two end portions of the retainer.

With a connector as described above, when the housing and the retainer are to be fitted together to be joined with one another, first, the retainer is inserted into the insertion hole of the housing and the provisional anchoring pieces of the housing are engaged with the provisional anchorage pawls of the retainer, putting the housing and the retainer into a provisional coupled state (a temporary joined state). Next, terminals are inserted into the terminal insertion holes of the housing, putting the terminals into a state of passing through the housing. Thereafter, the retainer is inserted further into the insertion hole of the housing, and the main anchoring pieces of the housing are engaged with the main anchorage pawls of the retainer. Hence, the terminals are held in place by the retainer, and are in a locked state. Moreover, the housing and the retainer are coupled with a precise positional relationship (a joined state).

However, in such a connector, the main anchoring pieces of the housing and the main anchorage pawls of the retainer, due to shapes thereof, are engaged with extremely small contact areas, similar to point contact. Consequently, when a reduction in size of the connector has been tried, these contact areas become even smaller and an engagement force between the housing and the retainer is reduced. Accordingly, there has been a disadvantage in that the housing and the retainer could not be joined with sufficient strength.

Furthermore, this problem has similarly arisen with the provisional anchoring pieces of the housing and the provisional anchorage pawls of the retainer.

SUMMARY OF THE INVENTION

Accordingly, schemes for coupling a housing with a retainer with sufficient strength, even when a connector is reduced in size, have been called for.

In consideration of the problem described above, a connector in which a housing and a retainer can be coupled with sufficient strength, even when reduced in scale, is required.

A connector relating to the present invention includes: a housing which is formed overall in a substantial box shape, the housing including an insertion hole which opens at one face thereof; a retainer which is formed to correspond with the insertion hole of the housing, the retainer being inserted into and fitting with the insertion hole for being put into a coupled state with the housing; a provisional anchoring piece formed, at each of two end portions of an inner peripheral wall of the insertion hole of the housing, with length in a direction along the inner peripheral wall that intersects a direction of the insertion of the retainer; a main anchoring piece formed at each of the two end portions of the inner peripheral wall of the insertion hole, at a downstream side in the insertion direction relative to the provisional anchoring piece, with length in the intersecting direction along the inner peripheral wall; and an anchorage pawl formed, at each of two end portions of the retainer, with length in the intersecting direction, the anchorage pawl being engageable with the provisional anchoring piece and the main anchoring piece, and the anchorage pawl engaging with the provisional anchoring piece for putting the housing and the retainer into a provisional joined state and engaging with the main anchoring piece for putting the housing and the retainer into the coupled state.

With the connector relating to the present invention, when the housing is to be joined with the retainer, the retainer is inserted into the insertion hole of the housing. When the retainer is inserted into the insertion hole of the housing, first, the anchorage pawls formed at the two end portions of the retainer engage with the provisional anchoring pieces formed at the two end portions of the inner periphery wall of the insertion hole of the housing. As a result, the housing and the retainer are provisionally coupled (temporarily joined).

Subsequently, when the retainer is inserted further into the insertion hole of the housing, the anchorage pawls of the retainer engage with the main anchoring pieces formed at the two end portions of the inner periphery wall of the insertion hole of the housing. As a result, the housing and the retainer are coupled.

Now, in this connector, the provisional anchoring pieces and main anchoring pieces of the housing are formed at the two end portions of the inner periphery wall of the insertion hole, with long sides in the direction along the inner periphery wall which intersects the direction of insertion of the retainer. The anchorage pawls of the retainer are also formed with long sides in this intersecting direction. Therefore, even if the connector itself is made smaller, contact areas of engaging portions between the housing and the retainer can be kept larger than in a conventional connector. In consequence, an engagement force of the provisional anchoring pieces with the anchorage pawls that is required for provisional joining of the housing with the retainer, and an engagement force of the main anchoring pieces with the anchorage pawls that is required for joining of the housing with the retainer can be thoroughly assured. Consequently, it is possible to couple (and provisionally couple) the housing and the retainer with sufficient strength.

In the present invention, a doubly supported beam portion may be formed at each of two side walls of the housing by a cutout, which communicates between the insertion hole and an exterior of the housing, being formed along the intersecting direction to give a retainer insertion side relative to the cutout the form of a doubly supported beam, with the provisional anchoring piece and the main anchoring piece being provided at the doubly supported beam portion.

In the connector in such a case, the cutouts are formed in each of the two side walls of the housing. The cutouts pass through between the insertion hole and the exterior of the housing. The cutouts are formed along the direction intersecting the direction of insertion of the retainer, and consequently the retainer insertion sides of the side walls relative to the cutouts are put into doubly supported beam states. Further, the provisional anchoring pieces and the main anchoring pieces are provided at the portions which are in these doubly supported beam states (which is to say, the doubly supported beam portions).

Hence, when the retainer is inserted into the insertion hole of the housing, the doubly supported beam portions are pushed aside, to outer sides thereof, by the retainer (the doubly supported beam portions are directed outward). When the anchorage pawls have moved to positions for engaging with the provisional anchoring pieces, or when the anchorage pawls have moved to positions for engaging with the main anchoring pieces, the doubly supported beam portions return to positions of a natural state thereof (i.e., the positions thereof prior to being pushed aside by the anchorage pawls).

Thus, as well as the insertion of the retainer into the insertion hole of the housing being simplified, the engagement pawls of the retainer reliably engage with the provisional anchoring pieces and the main anchoring pieces of the housing.

At a connector relating to the present invention as described above, it is possible to couple a housing with a retainer with sufficient strength, even with a reduction in scale.

DETAILED DESCRIPTION OF THE INVENTION

Figure 1:
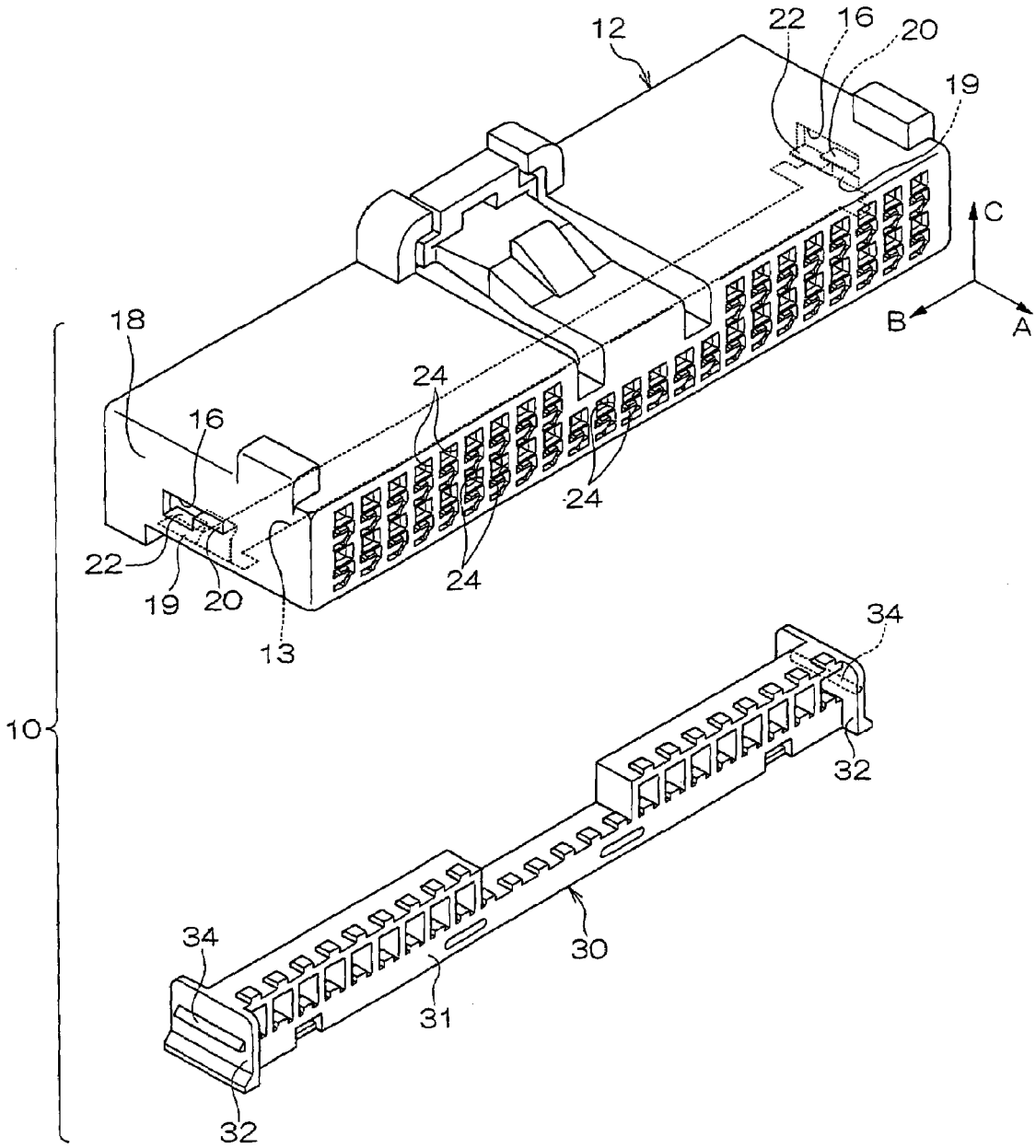
FIG. 1 is an exploded perspective view showing general structure of a connector relating to an embodiment of the present invention.
Figure 2:
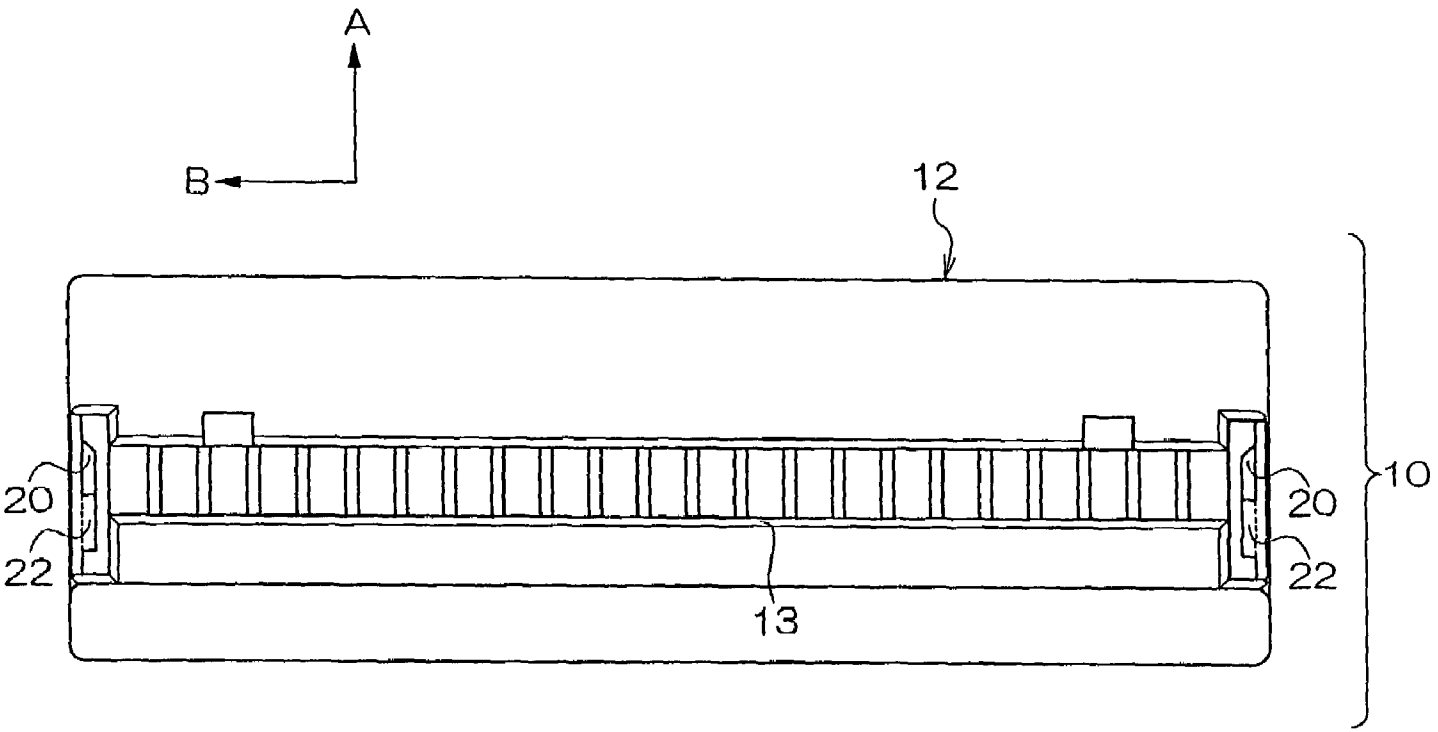
FIG. 2 is a bottom view of a housing.
Figure 3:
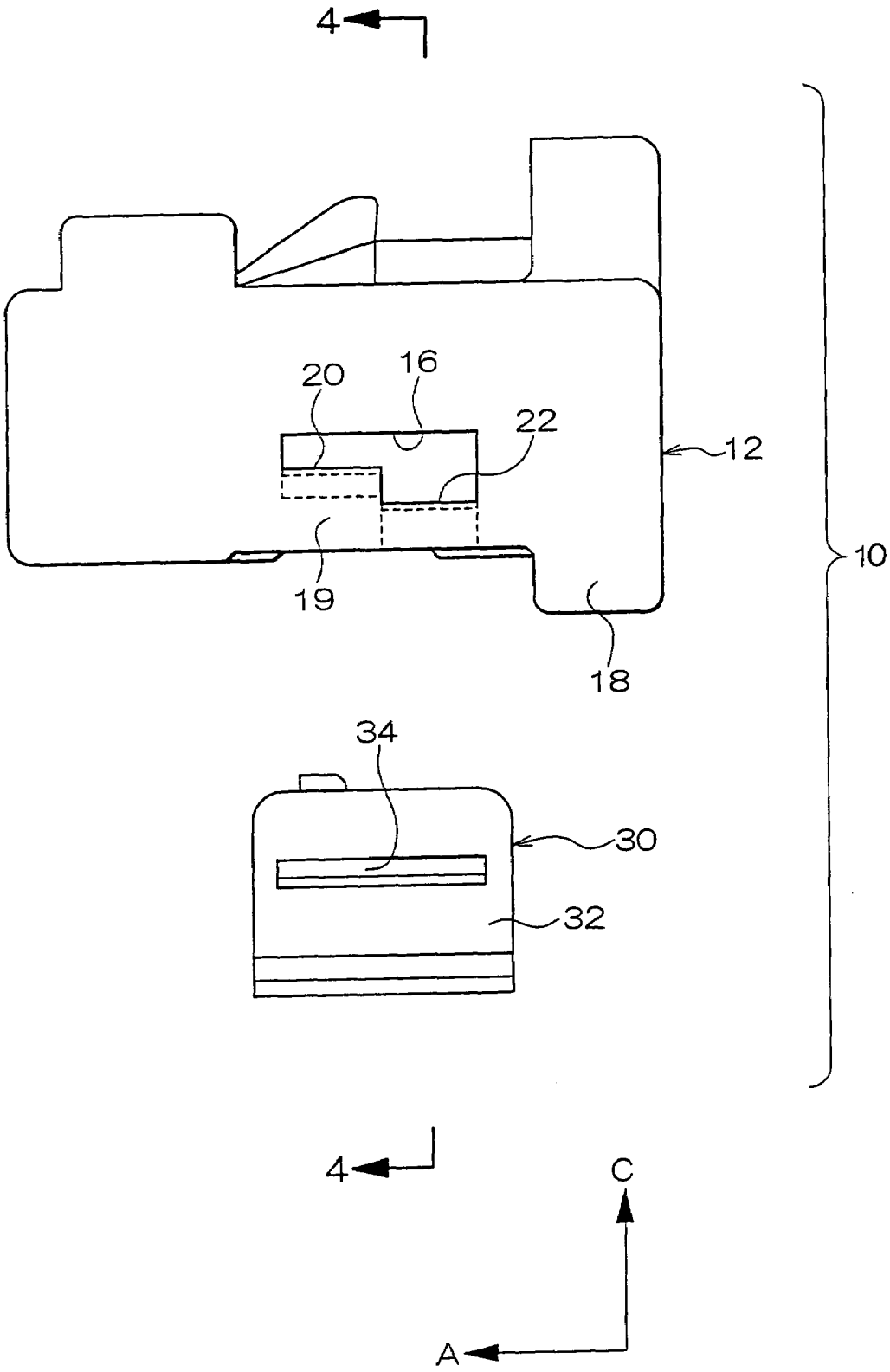
FIG. 3 is a right side view of the connector according to FIG. 1.
Figure 4:
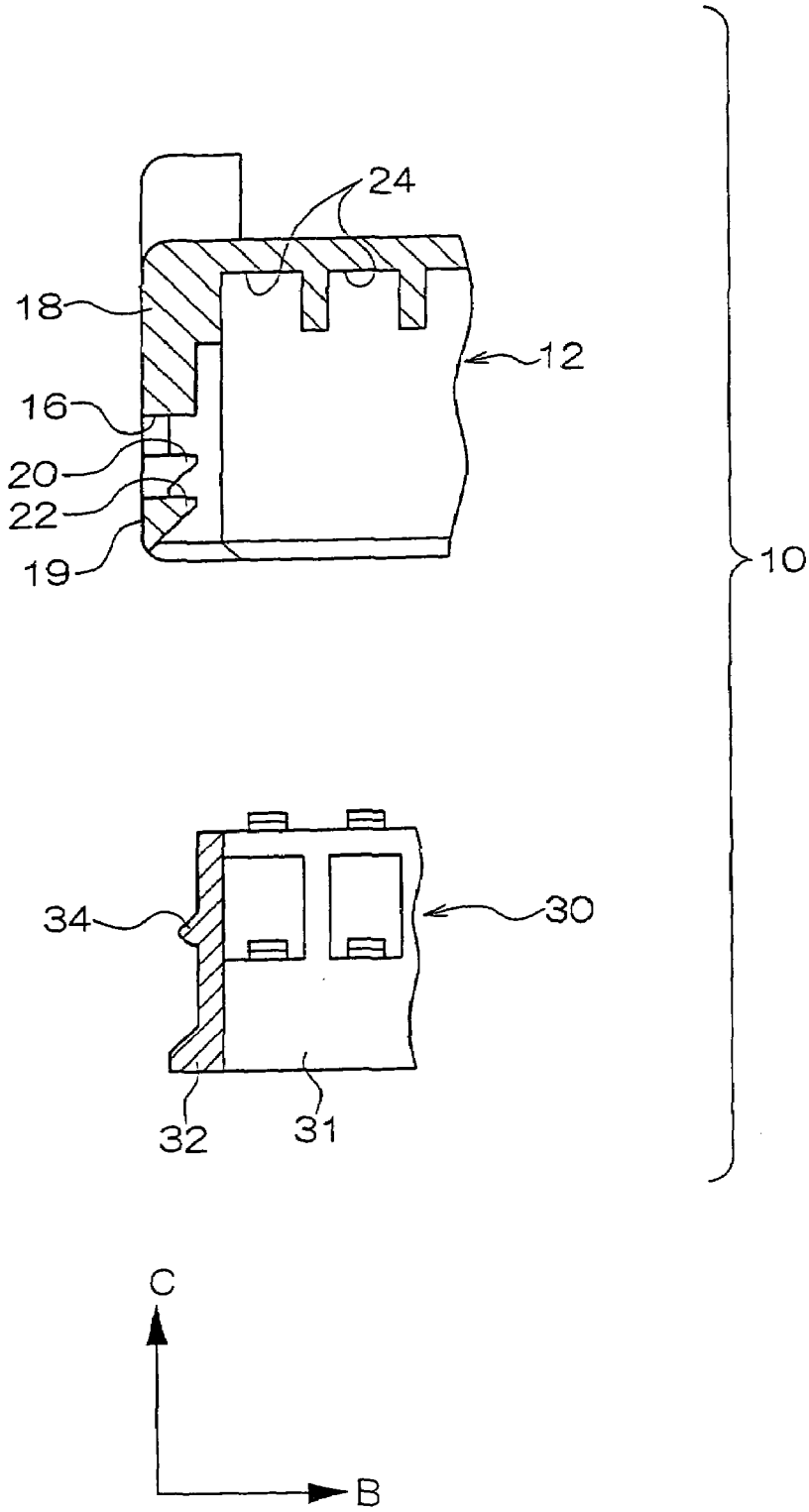
FIG. 4 is a cross-sectional view of the connector, cut along line 4–4 of FIG. 3.

A connector 10 relating to an embodiment of the present invention will be described. Hereafter, for convenience of description, a direction which is shown by an arrow A where appropriate in the drawings is referred to as rearward, a direction shown by an arrow B, which intersects arrow A, is referred to as leftward, and a direction shown by an arrow C, which intersects arrow A and arrow B, is referred to as upward. FIG. 1 shows an exploded perspective view of the connector 10, and FIG. 2 shows a bottom view of a housing 12 of the connector 10. Further, FIG. 3 shows a right side view of the connector 10 according to FIG. 1, and FIG. 4 shows a cross-sectional view of the connector 10, cut along line 4—4 of FIG. 3.

As shown in FIG. 1, the connector 10 is provided with the housing 12 and a retainer 30. The housing 12 of the connector 10 is constituted of a resin material and is formed in a substantially rectangular box shape. Terminal insertion holes 24, for insertion of unillustrated terminals, are formed in the housing 12. The terminal insertion holes 24 are formed in the front-rear direction and, in a state in which the terminals have been inserted through the terminal insertion holes 24 and mounted at the housing 12, the terminals pass through the housing 12 in the front-rear direction. These terminal insertion holes 24 are formed at two levels, an upper level and a lower level. The terminal insertion holes 24 of the lower level are provided at a plurality of locations which are equidistant along the left-right direction. The terminal insertion holes 24 of the upper level are provided above the terminal insertion holes 24 of the lower level at a plurality of locations which are equidistant along the left-right direction, except at a central portion. In other words, in a rear face view, the group of terminal insertion holes 24 form a substantial 'U' shape overall.

An insertion hole 13, for insertion of the retainer 30, is formed at a bottom face side of the housing 12. The insertion hole 13 is formed to be long in the left-right direction, has a form which is incised further in the forward and rearward directions at each of two left-right direction end portions thereof (see FIG. 2), and opens to the bottom face side (i.e., downward). In other words, in a bottom face view, the insertion hole 13 is formed in a substantial 'H' shape overall. Furthermore, the insertion hole 13 is formed to correspond with the group of terminal insertion holes 24, and is thus formed in a substantial 'U' shape in a rear cross-sectional view.

A pair of side walls 18 define the two left-right direction ends of the housing 12. Cutouts 16 are formed in the left-right direction through the side walls 18, and communicate between an outer side of each side wall 18 (the exterior) and the insertion hole 13. As shown in FIG. 3, each cutout 16 is formed to be long in the front-rear direction, and an incision further downward is formed at the front-rear direction forward side of the cutout 16. Overall, the cutout 16 is formed in a substantial 'L' shape. At a time of molding of the housing 12, these cutouts 16 are utilized as holes for slide pieces.

At each side wall 18, a lower side of the cutout 16 (a side of insertion of the retainer 30, which is described later) is formed to be long in the front-rear direction, and has the form of a doubly supported beam which is supported at two front-rear direction end portions of the side wall 18. This portion serves as a beam 19, which serves as a doubly supported beam portion.

As shown in FIGS. 3 and 4, a provisional anchoring piece 22 is formed at an inner side (the insertion hole 13 side) of the beam 19. The provisional anchoring piece 22 is formed below the front-rear direction forward side of the cutout 16. The provisional anchoring piece 22 is formed to be long in the front-rear direction. An upper end of the provisional anchoring piece 22 serves as a flat surface, the normal direction of which is the up-down direction. The provisional anchoring piece 22 also features a taper surface, which is angled toward a left-right direction outer side from a left-right direction inner side end portion of the upper end of the provisional anchoring piece 22 to the lower end of the provisional anchoring piece 22. This provisional anchoring piece 22 corresponds with an anchorage pawl 34 of the later-described retainer 30, and is formed to be capable of engaging with the anchorage pawl 34.

A main anchoring piece 20 is also formed at the inner side of the beam 19, below the front-rear direction rearward side of the cutout 16. The main anchoring piece 20 is formed to be long in the front-rear direction. This main anchoring piece 20 is provided to be formed continuously with the above-described provisional anchoring piece 22 in the front-rear direction but spaced apart from the provisional anchoring piece 22 in the up-down direction. An upper end of the main anchoring piece 20 serves as a flat surface, the normal direction of which is the up-down direction. The main anchoring piece 20 also features a taper surface, which is angled toward the left-right direction outer side, from a left-right direction inner side end portion of the upper end of the main anchoring piece 20 to the lower end of the main anchoring piece 20. The main anchoring piece 20 corresponds with the anchorage pawl 34 of the later-described retainer 30, and is formed to be capable of engaging with the anchorage pawl 34. A space between the main anchoring piece 20 and the above-described provisional anchoring piece 22 serves as a provisional engagement position of the anchorage pawl 34 of the retainer 30 (a position at which the housing 12 and the retainer 30 are provisionally joined). Further, the top of the upper face of the provisional anchoring piece 22 serves as a main engagement position of the anchorage pawl 34 (a position at which the housing 12 and the retainer 30 are joined).

The retainer 30 is constituted by a resin material, and is formed to correspond with the insertion hole 13 of the housing 12. The retainer 30 is provided with a main portion 31, which corresponds with portions of the insertion hole 13 apart from two left-right direction end portions thereof. The main portion 31 is formed with a shape corresponding with the group of terminal insertion holes 24 of the housing 12 (see FIG. 1), and is formed in a substantial 'U' shape in a rear view.

A substantially plate-like plate-form portion 32 is integrally formed at each of two left-right direction end portions of the main portion 31 of the retainer 30. Plate thickness directions of this pair of plate-form portions 32 are parallel with the left-right direction. An outer side (a left-right direction end portion) of each plate-form portion 32 corresponds with an inner side (a left-right direction end portion) of the insertion hole 13 of the housing 12. When the retainer 30 has been inserted into and fitted with the housing 12, the outer sides of the plate-form portions 32 oppose the inner sides of the side walls 18 of the housing 12.

The anchorage pawls 34, which are formed to be somewhat longer than the cutouts 16 in the front-rear direction, are formed integrally at the outer sides of the plate-form portions 32 which are provided at the retainer 30 described above. The anchorage pawls 34 correspond with the provisional anchoring pieces 22 of the housing 12, and are formed to be engageable with the provisional anchoring pieces 22. When the retainer 30 is inserted into the insertion hole 13 of the housing 12 from below, each anchorage pawl 34 of the retainer 30 pushes the provisional anchoring piece 22 of the housing 12 aside, to the outer side. When the anchorage pawl 34 has moved to the position between the provisional anchoring piece 22 and the main anchoring piece 20 in the up-down direction (i.e., the aforementioned provisional engagement position), the provisional anchoring piece 22 returns to a position of a natural state thereof (i.e., a position thereof prior to the side wall 18, and the provisional anchoring piece 22, being pushed aside by the anchorage pawl 34), and the anchorage pawl 34 engages with the provisional anchoring piece 22. Thus, the retainer 30 is locked in the housing 12 (see FIGS. 5 and 6).

Further, the anchorage pawl 34 also corresponds with the main anchoring piece 20 provided at the housing 12, and is formed to be engageable with the main anchoring piece 20. Further to the state in which the retainer 30 has been locked in the housing 12 (the provisional joining state), the unillustrated terminals are inserted into the terminal insertion holes 24 and passed through the housing 12. From this state, the anchorage pawl 34 of the retainer 30 is advanced further upward from the above-described provisionally stopped position. The anchorage pawl 34 pushes the main anchoring piece 20 of the housing 12 aside, to the left-right direction outer side, and moves to above the upper face of the main anchoring piece 20 (i.e., the aforementioned main engagement position). When the anchorage pawl 34 has moved to this position, the main anchoring piece 20 returns to a position of the natural state (i.e., a position thereof prior to the side wall 18, and the main anchoring piece 20, being pushed aside by the anchorage pawl 34), and the anchorage pawl 34 engages with the main anchoring piece 20. The retainer 30 pushes the unillustrated terminals against upper sides of inner faces of the terminal insertion holes 24 and locks the unillustrated terminals in the housing 12. In addition, the retainer 30 itself is locked in the housing 12 (see FIGS. 7 and 8).

Next, operations of this embodiment of the present invention will be described.

From a state in which the housing 12 and the retainer 30 are unassembled, the retainer 30 is inserted into the insertion hole 13 of the housing 12.

At this time, the anchorage pawls 34 of the retainer 30 abut against the taper surfaces of the provisional anchoring pieces 22, which are provided at the inner sides of the side walls 18 of the housing 12, while the anchorage pawls 34 are being inserted upward relative to the housing 12. When the anchorage pawls 34 are inserted, the provisional anchoring pieces 22, and therefore the beams 19, are pushed aside to the left-right direction outer sides (the beams 19 are directed to the outer sides thereof). As a result, the retainer 30, and more specifically the anchorage pawls 34 of the retainer 30, becomes capable of proceeding to upward of the provisional anchoring pieces 22.

Figure 5:
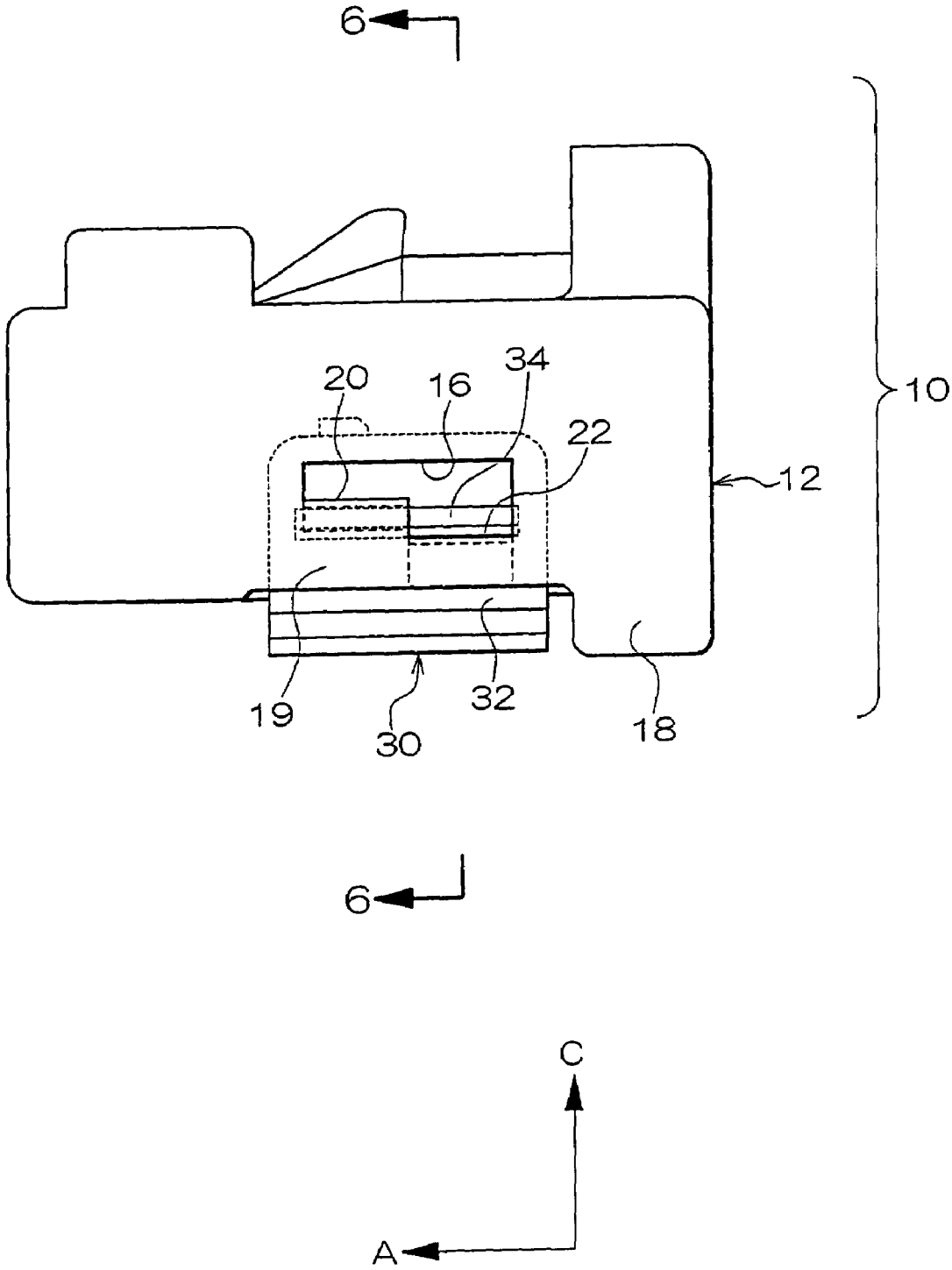
FIG. 5 is a right side view of the housing and a retainer, which has been inserted to a provisional engagement position.
Figure 6:
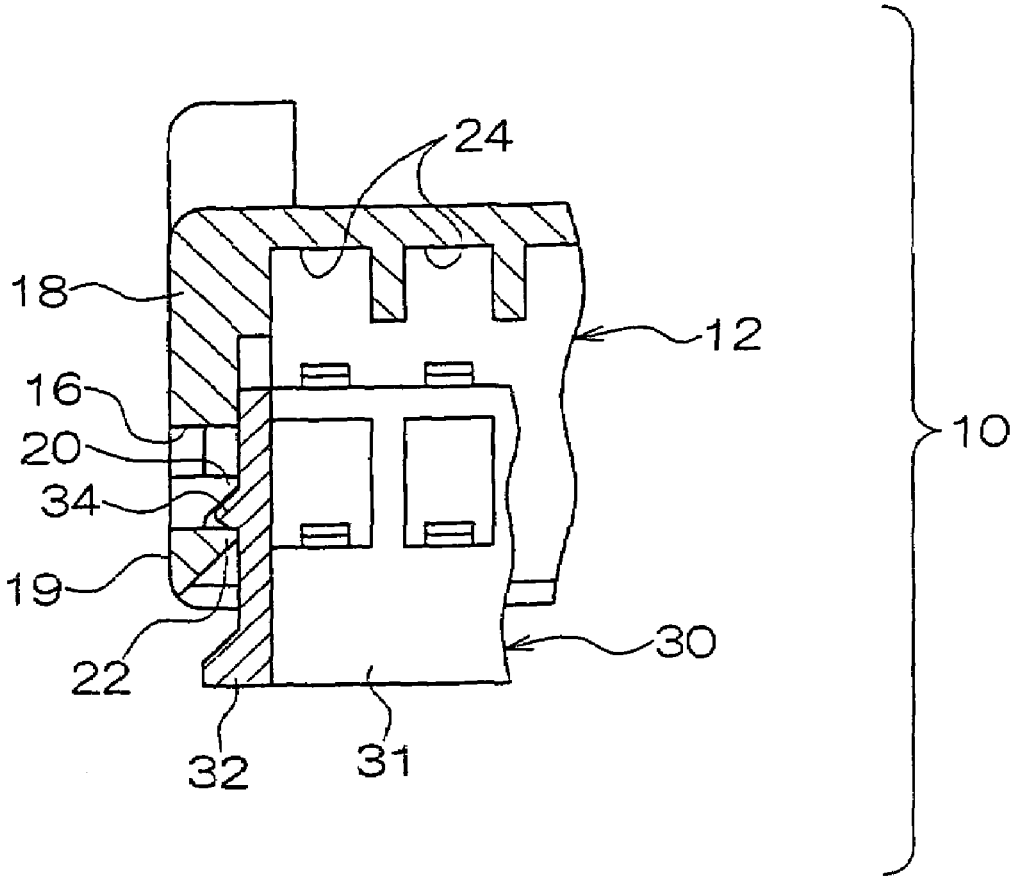
FIG. 6 is a cross-sectional view of the connector, cut along line 6–6 of FIG. 5.
Figure 6:
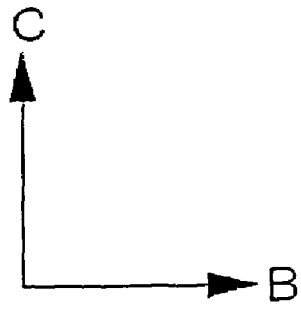

When the retainer 30 is inserted further into the insertion hole 13 and the anchorage pawls 34 of the retainer 30 advance to upward of the provisional anchoring pieces 22, the provisional anchoring pieces 22, and therefore the beams 19, of the housing 12 return to the original positions thereof at the left-right direction inner sides (i.e., the positions thereof prior to being pushed aside by the anchorage pawls 34), and the anchorage pawls 34 of the retainer 30 are provisionally fixed at the provisional engagement positions between the provisional anchoring pieces 22 and main anchoring pieces 20 of the housing 12 (see FIGS. 5 and 6).

Here, when the anchorage pawls 34 of the retainer 30 are provisionally fixed at the provisional engagement positions, the retainer 30 is provisionally fixed to the housing 12. In this state, the retainer 30 is locked in the housing 12 (i.e., a provisional joined state of the housing 12 with the retainer 30).

Then, while the retainer 30 is provisionally fixed to the housing 12, the unillustrated terminals are inserted into the terminal insertion holes 24, from the rear side, until the terminals pass through the housing 12.

Thereafter, in the state in which the unillustrated terminals pass through the housing 12, the anchorage pawls 34 of the retainer 30 are inserted further upward relative to the housing 12 while abutting against the taper surfaces of the main anchoring pieces 20 of the housing 12. Accordingly, the main anchoring pieces 20, and therefore the beams 19, are pushed aside to the left-right direction outer sides (the beams 19 are directed to the outer sides). As a result, the retainer 30, and more specifically the anchorage pawls 34 of the retainer 30, becomes capable of proceeding to upward of the main anchoring piece 20.

Figure 7:
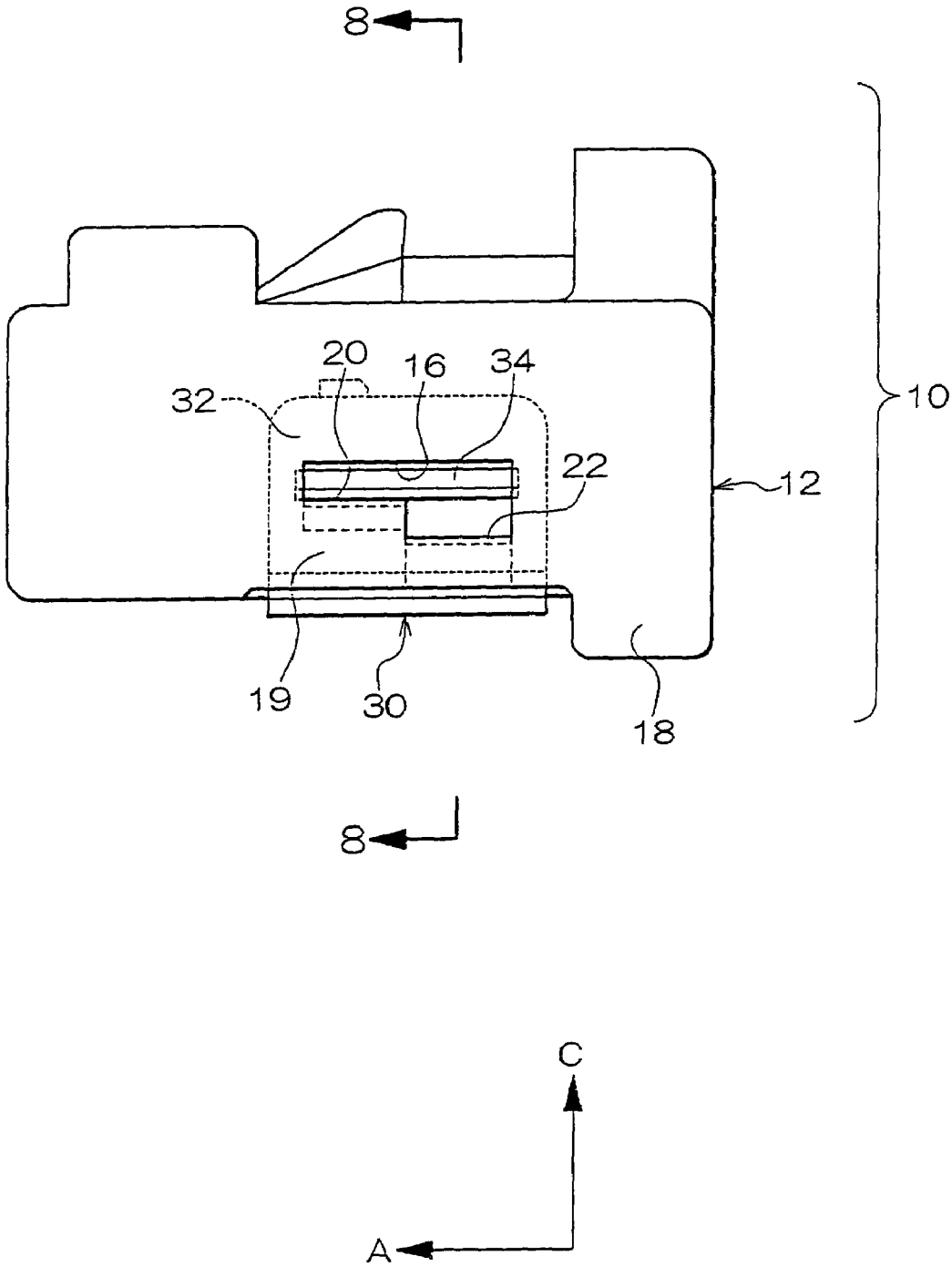
FIG. 7 is a right side view of the housing and the retainer, which has been inserted to a main engagement position.
Figure 8:
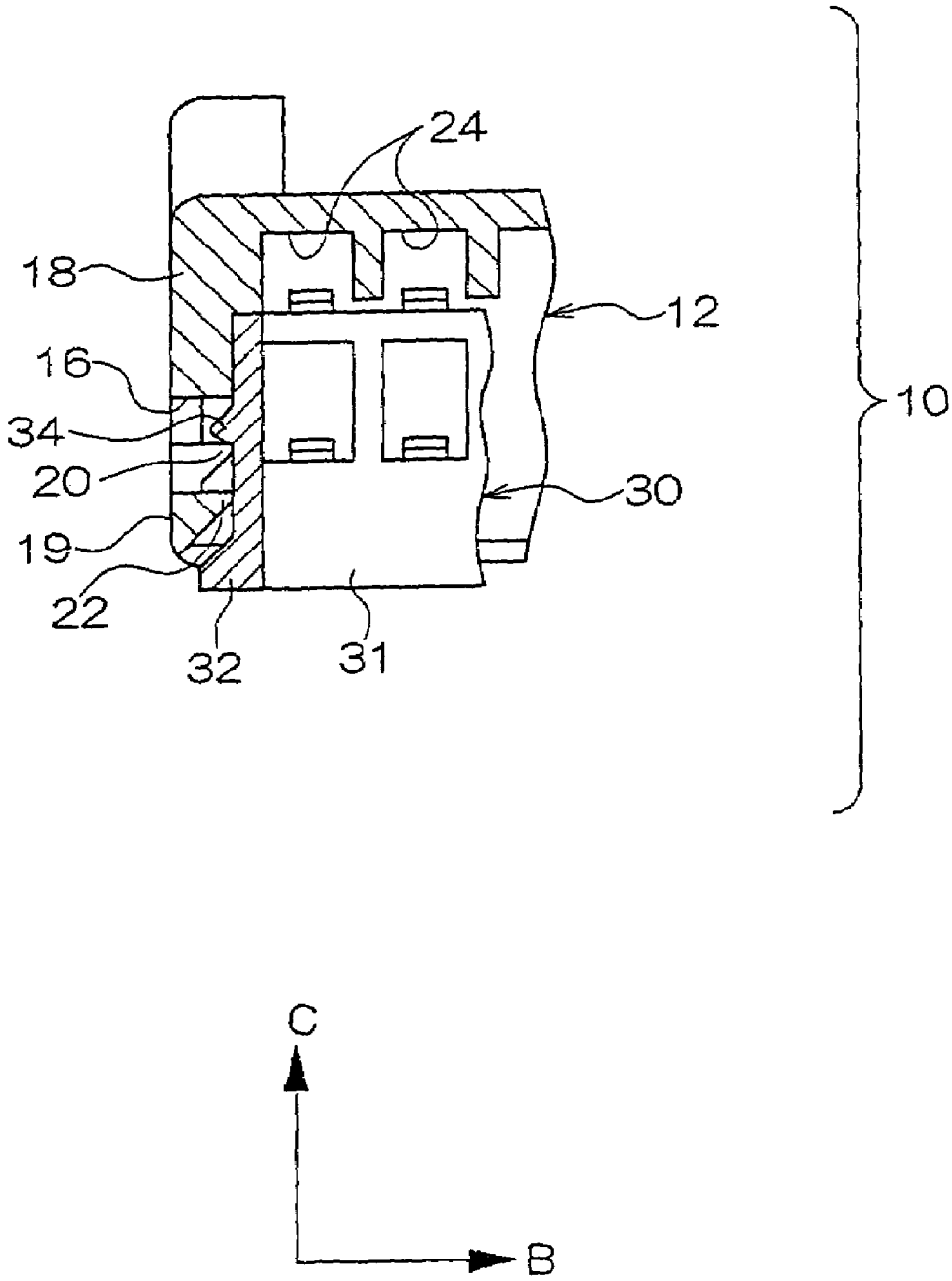
FIG. 8 is a cross-sectional view of the connector, cut along line 8–8 of FIG. 7.

When the retainer 30 is inserted further into the insertion hole 13 and the anchorage pawls 34 of the retainer 30 advance to upward of the main anchoring pieces 20, the main anchoring pieces 20, and therefore the beams 19, of the housing 12 return to the original positions thereof at the left-right direction inner sides (i.e., the positions thereof prior to being pushed aside by the anchorage pawls 34), and the anchorage pawls 34 of the retainer 30 are fixed at the main engagement positions above the main anchoring pieces 20 of the housing 12 (see FIGS. 7 and 8).

When the anchorage pawls 34 of the retainer 30 are fixed at the main engagement positions of the housing 12, the retainer 30 locks the unillustrated terminals which have been inserted into the terminal insertion holes 24 of the housing 12, and the retainer 30 itself is locked in the insertion hole 13 of the housing 12 (i.e., a proper joined state of the housing 12 with the retainer 30).

Thus, the retainer 30 is assembled to the housing 12, and the connector 10 is completed.

Now, in this connector 10, the provisional anchoring pieces 22 and main anchoring pieces 20 of the housing 12 are formed at the inner sides of the side walls 18 with lengths in a direction along the side walls 18 that intersects a direction of insertion of the retainer 30 into the insertion hole 13 (i.e., in the front-rear direction). The anchorage pawls 34 of the retainer 30 are also formed with lengths in this intersecting direction. Therefore, even if the connector 10 as a whole is made smaller, contact areas of engagement portions between the housing 12 and the retainer 30 can be kept larger than in conventional connectors. As a result, an engagement force between the provisional anchoring pieces 22 and the anchorage pawls 34 that is required for provisional joining of the housing 12 with the retainer 30, and an engagement force between the main anchoring pieces 20 and the anchorage pawls 34 that is required for joining of the housing 12 with the retainer 30 can be thoroughly assured. Consequently, it is possible to couple (and provisionally couple) the housing 12 and the retainer 30 with sufficient strength.

Moreover, because the beams 19 at which the provisional anchoring pieces 22 and the main anchoring pieces 20 are provided have the form of doubly supported beams, when the anchorage pawls 34 of the retainer 30 push aside the provisional anchoring pieces 22 or main anchoring pieces 20 of the housing 12 to the left-right direction outer sides thereof, the beams 19 formed at the side walls 18 of the housing 12 act as doubly supported beams. Hence, when the anchorage pawls 34 of the retainer 30 move to the provisional engagement position or the main engagement position, the provisional anchoring pieces 22 or main anchoring pieces 20 of the housing 12 resiliently return to natural state positions thereof, due to forces opposite to forces of when the provisional anchoring pieces 22 or main anchoring pieces 20 are pushed aside to the left-right direction outer sides by the anchorage pawls 34 of the retainer 30.

Thus, as well as insertion of the retainer 30 into the insertion hole 13 of the housing 12 being simple, the provisional anchoring pieces 22 and the main anchoring pieces 20 of the housing 12 can reliably engage with the anchorage pawls 34 of the retainer 30, which is appropriate.

What is claimed is:

1. A connector comprising:

a housing which is formed overall in a substantial box shape, the housing including an insertion hole which opens at one face thereof, and two side walls on either side of said insertion hole;

a retainer which is formed to correspond with the insertion hole of the housing, the retainer being inserted into and fitting with the insertion hole for being put into a coupled state with the housing;

a provisional anchoring piece formed, at inner peripheral portions of said two side walls on either side of the insertion hole of the housing, with length in a direction along the inner peripheral portion that intersects a direction of the insertion of the retainer;

a main anchoring piece formed at inner peripheral portions of the insertion hole, at a downstream side in the insertion direction relative to the provisional anchoring piece, with length in the intersecting direction along the inner peripheral portion; and an anchorage pawl formed, at each of two end portions of the retainer, with length in the intersecting direction that substantially traverses the length of the end portion of the retainer, the anchorage pawl at each end being engageable with the provisional anchoring piece and the main anchoring piece of the one of said two side walls, and the anchorage pawl engaging with the provisional anchoring piece for putting the housing and the retainer into a provisional joined state and engaging with the main anchoring piece for putting the housing and the retainer into the coupled state, wherein both said provisional anchoring piece and said main anchoring piece are formed at least in part by a single cutout in each of said side walls and located beside and offset from said provisional anchoring piece.

2. The connector of claim 1, wherein a doubly supported beam portion is formed at each of said two side walls of the housing by said cutout, said cutout extending completely through said side walls and communicating between the insertion hole and an exterior of the housing, and being formed along the direction that intersects a direction of insertions of the retainer to give a retainer insertion side relative to the cutout the form of a doubly supported beam, and wherein the provisional anchoring piece and the main anchoring piece are provided at the doubly supported beam portion.

3. A connector according to claim 1, wherein the combined length of said anchoring pieces along said intersecting direction is substantially the same as the length of the single anchorage pawl.

4. A connector according to claim 1, wherein only a single anchorage pawl is formed at each of two end portions of the retainer.

* * * * *